US007607196B2

(12) United States Patent
Li

(10) Patent No.: US 7,607,196 B2
(45) Date of Patent: Oct. 27, 2009

(54) VACUUM CLEANER WITH SUCTION HEAD WITH LOCKING MEANS OF PIVOTAL MOVEMENT ABOUT AXIS OF ROTATION

(75) Inventor: Chun Kit Li, Lancashire (GB)

(73) Assignee: Dyson Technology Limited, Wiltshire (GB)

( * ) Notice: Subject to any disclaimer, the term of this patent is extended or adjusted under 35 U.S.C. 154(b) by 0 days.

(21) Appl. No.: 12/158,948

(22) PCT Filed: Dec. 14, 2006

(86) PCT No.: PCT/GB2006/004677

§ 371 (c)(1),
(2), (4) Date: Jun. 23, 2008

(87) PCT Pub. No.: WO2007/071934

PCT Pub. Date: Jun. 28, 2007

(65) Prior Publication Data

US 2009/0044368 A1 Feb. 19, 2009

(30) Foreign Application Priority Data

Dec. 23, 2005 (GB) ..... 0526417.1

(51) Int. Cl.
*A47L 5/28* (2006.01)

(52) U.S. Cl. ..... 15/350; 15/351; 15/410; 15/411

(58) Field of Classification Search ..... 15/327.2, 15/350, 351, 410, 411; *A47L 9/00, 5/28*
See application file for complete search history.

(56) References Cited

U.S. PATENT DOCUMENTS 2,464,587 A 3/1949 Knight
5,584,095 A 12/1996 Redding et al.

FOREIGN PATENT DOCUMENTS

| | | | |
|---|---|---|---|
| DE | 201 10 143 | U1 | 2/2002 |
| EP | 0 451 443 | A1 | 10/1991 |
| EP | 0 909 546 | A2 | 4/1999 |
| FR | 695-814 | | 12/1930 |
| GB | 286584 | | 3/1928 |
| GB | 608238 | | 9/1948 |
| GB | 2 391 459 | A | 2/2004 |
| WO | WO-2004/014210 | A1 | 2/2004 |

OTHER PUBLICATIONS

International Search Report, mailed Jul. 19, 2007, directed to counterpart International Application No. PCT/GB2006/004677. 9 pages.
Written Opinion of the International Searching Authority, mailed Jul. 19, 2007, directed to International Application No. PCT/GB2006/004677. 11 pages.
Search Report under Section 17(5), mailed Feb. 23, 2006, directed to counterpart Foreign Application No. GB0526417.1. 3 pages.

*Primary Examiner*—David A Redding
(74) *Attorney, Agent, or Firm*—Morrison & Foerster LLP

(57) ABSTRACT

A vacuum cleaner includes a head for contacting the ground and a body which is pivotable relative to the head about a first axis of rotation and about a second axis of rotation. The body has a locking mechanism and the head has a reciprocal locking mechanism which are arranged such that the locking mechanism is engageable with the reciprocal locking mechanism so as to resist pivotal movement of the body relative to the head about the first axis of rotation. The locking mechanism is disengageable from the reciprocal locking mechanism to allow pivotal movement of the body relative to the head about the first axis of rotation. The vacuum cleaner also includes a stabilizer coupled to the head such that in use the stabilizer maintains contact with the ground when the body is rotated relative to the head about the first or second axis of rotation.

15 Claims, 8 Drawing Sheets

VACUUM CLEANER WITH SUCTION HEAD WITH LOCKING MEANS OF PIVOTAL MOVEMENT ABOUT AXIS OF ROTATION

REFERENCE TO RELATED APPLICATIONS

This application is a national stage application under 35 USC 371 of International Application No. PCT/GB06/004677, filed Dec. 14, 2006, which claims the priority of United Kingdom Application No. 0526417.1, filed Dec. 23, 2005, the contents of both of which prior applications are incorporated herein by reference.

FIELD OF THE INVENTION

The present invention relates to toy vacuum cleaners and to vacuum cleaners in general.

BACKGROUND OF THE INVENTION

One type of vacuum cleaner has a head and a body. The head contacts the ground and includes a sucking aperture, and the body has a handle. The body is pivotable between an upright position storage position and an inclined use position. In some vacuum cleaners, such as a Dyson DC15 vacuum cleaner, the body is pivotable laterally with respect to the head, as well as towards and backwards from the head, thereby allowing the vacuum cleaner to be steered around obstacles more easily. The Dyson DC15 vacuum cleaner achieves this by supporting the body and the head on a ball instead of on wheels. The body and the head are connected to the ball such that the ball and the body are pivotable laterally relative to the head, and such that the ball is rotatable, thereby also allowing the ball to function like a wheel.

The Dyson DC15 vacuum cleaner also has a pair of rear support wheels which can be fixed in a ground-contacting position to enable the body to be maintained in the upright storage position. The rear support wheels are mounted on a support structure, and the support structure is rotatably mounted on the body. When the vacuum cleaner is in use, the rear support wheels and the support structure can be released from the fixed ground-contacting position, thereby allowing the body to pivot laterally relative to the head.

The inventors are concerned with toy vacuum cleaners, particularly toy vacuum cleaners in which the body is pivotable laterally relative to the head. The present inventors believe that a toy vacuum cleaner having such a rear movable support is not optimally safe for children. For example the moveable rear support may lead to a child being hurt. Also, it is desirable to reduce the number of moving parts on toys to increase robustness. This also decreases the possibility that the toy may be broken, which may expose dangerous sharp edges.

The inventors have reduced the above drawback relating to toy vacuum cleaners by providing toy vacuum cleaners in which the body can be maintained more easily in the upright storage position. These vacuum cleaners also preferably retain the ability of the body to pivot laterally relative to the head.

The inventors have also realised that the improvements to toy vacuum cleaners are also applicable to real vacuum cleaners.

SUMMARY OF THE INVENTION

At its most general, the invention provides a mechanism for a vacuum cleaner which resists movement of the body relative to the head when the body is in a storage position, which mechanism can be readily released by movement of the body by the user.

In a first aspect the invention provides:

A vacuum cleaner including a head for contacting the ground and a body, wherein the body is pivotable relative to the head about a first axis of rotation and about a second axis of rotation, wherein the body has a means for locking and the head has a reciprocal means for locking, wherein the means for locking and the reciprocal means for locking are arranged such that the means for locking is engageable with the reciprocal means for locking, thereby resisting pivotal movement of the body relative to the head about the first axis of rotation, and wherein the means for locking is disengageable from the reciprocal means for locking by pivotal movement of the body relative to the head, thereby allowing pivotal movement of the body relative to the head about the first axis of rotation.

Importantly, the means for locking can be automatically engaged or disengaged from the reciprocal means for locking simply by pivoting the body relative to the head, preferably about the first or the second axis of rotation. This obviates any need for a rear support to prevent lateral movement of the body relative to the head when the vacuum cleaner is in the storage position (substantially upright). Therefore, toy vacuum cleaners of the invention are safer for children, and are simpler to operate.

The invention may also provide advantages for real vacuum cleaners, for example greater robustness and ease of use.

The head of the vacuum cleaner may house an aperture through which dirt enters the vacuum cleaner, and the body of the vacuum cleaner may house a receptacle for the dirt. The body may be mounted, for example pivotally mounted, on the head, and the body may include a handle to allow a user to move the vacuum cleaner over the ground.

Preferably the head and the body are arranged such that the body is movable laterally relative to the head by pivotal movement about the first axis of rotation, and the body is movable towards the head and backwards from the head by pivotal movement about the second axis of rotation.

Preferably the means for locking and the reciprocal means for locking are arranged such that the means for locking engages with the reciprocal means for locking when the body is in a storage position (substantially upright), thereby resisting the body moving laterally relative to the head when the body is in the storage position.

Therefore the means for locking automatically engages with the reciprocal means for locking when the body is in the storage position.

The body is in a substantially upright position when the vacuum cleaner is in the storage position, i.e. the body is in a substantially vertical position when the head is on the ground. For the avoidance of doubt, the term "substantially upright position" is interchangeable with the term "storage position".

In an embodiment of the invention, the means for locking and the reciprocal means for locking are arranged such that the means for locking is disengageable from the reciprocal means for locking by pivotal movement of the body relative to the head about the second axis of rotation, thereby allowing pivotal movement of the body relative to the head about the first axis of rotation.

Therefore the means for locking can be automatically disengaged from the reciprocal means for locking by pivoting the body relative to the head about the second axis of rotation.

After the means for locking has disengaged from the reciprocal means for locking the body is movable, preferably freely movable, relative to the head about the first axis of rotation.

Preferably the head and the body are arranged such that when the body is in the substantially upright position, movement of the body backwards from the head disengages the means for locking from the reciprocal means for locking, thereby allowing the body to move laterally relative to the head.

Therefore, when the body in the storage position (substantially upright) the body resists lateral movement relative to the head. Moving the body backwards from the head from the upright position automatically disengages the means for locking from the reciprocal means for locking, thereby restoring the ability of the body to be movable, preferably freely movable, laterally relative to the head.

Preferably the body is freely movable relative to the head about the first axis of rotation when there is substantially the same resistance and/or minimal resistance to movement of the body relative to the head between a first position and a second position about the first axis of rotation.

Preferably engagement of the means for locking with the reciprocal means for locking prevents pivotal movement of the body relative to the head about the first axis of rotation. Preferably engagement of the means for locking with the reciprocal means for locking prevents lateral movement of the body relative to the head.

Therefore engagement of the means for locking with the reciprocal means for locking securely maintains the body in the storage position (substantially upright) by preventing lateral movement of the body relative to the head when the body is in the storage position.

In a further embodiment, the means for locking and the reciprocal means for locking are arranged such that the means for locking is disengageable from the reciprocal means for locking by pivotal movement of the body relative to the head about the first axis of rotation, thereby allowing pivotal movement of the body relative to the head about the first axis of rotation.

Therefore, according to this arrangement, the means for locking can be automatically disengaged from the reciprocal means for locking by pivoting the body relative to the head about the first axis of rotation.

Preferably the head and the body are arranged such that when the body is in the substantially upright position, movement of the body laterally relative to the head disengages the means for locking from the reciprocal means for locking, thereby allowing the body to move laterally relative to the head.

Therefore, when the body in the storage position (substantially upright) the body resists lateral movement relative to the head. Moving the body laterally relative to the head, for example by a user, automatically disengages the means for locking from the reciprocal means for locking, thereby restoring the ability of the body to be moved, preferably freely moved, laterally relative to the head.

Preferably the means for locking and the reciprocal means for locking are arranged such that a sufficient amount of force is required to disengage the means for locking from the reciprocal means for locking, thereby allowing pivotal movement of the body relative to the head about the first axis of rotation. Preferably the means for locking and the reciprocal means for locking are arranged such that a sufficient amount of force is required to move the body laterally relative to the head when the means for locking is engaged with the reciprocal means for locking.

Therefore, engagement of the means for locking with the reciprocal means for locking provides a force which resists lateral movement of the body relative to the head. The sufficient amount of force required to move the body laterally relative to the head when the means for locking is engaged with the reciprocal means for locking is therefore equivalent or comparable to the amount of force required to disengage the means for locking from the reciprocal means for locking.

The sufficient amount of force required to disengage the means for locking from the reciprocal means for locking is greater, preferably significantly greater, than the amount of force required to move the body laterally relative to the head, when the means for locking is not engaged with the reciprocal means for locking.

Therefore, the body preferably may not be moved laterally relative to the head when the means for locking is engaged with the reciprocal means for locking until the user intentionally applies the sufficient amount of force, which sufficient amount of force disengages the means for locking from the reciprocal means for locking. Therefore the means for locking is generally not disengageable from the reciprocal means for locking by gravity alone, or by accidentally knocking the vacuum cleaner. Preferably the sufficient amount of force is small such that little or no physical exertion is required from the user.

In a further embodiment the vacuum cleaner includes means for maintaining the body in a substantially upright position, wherein the means for maintaining the body in the substantially upright position is arranged such that a sufficient amount of force is required to move the body from the substantially upright position backwards from the head.

The means for maintaining the body in the storage position (substantially upright) therefore provides a force which resists movement of the body towards the head and backwards from the head when the body is in the storage position (substantially upright). The sufficient amount of force required to move the body from the storage position (substantially upright) backwards from the head, is therefore equivalent or comparable to the amount of force required to overcome the force which resists movement of the body towards the head, or backwards from the head when the body is in the storage position (substantially upright).

Therefore, the body may not be movable from the storage position (substantially upright) backwards from the head until the user intentionally applies the sufficient amount of force to move the body from the storage position (substantially upright) backwards from the head, thereby releasing the body from the upright position. Therefore the body is generally not movable from the storage position (substantially upright) backwards from the head by gravity alone, or by accidentally knocking the vacuum cleaner. In addition, preferably the sufficient amount of force required to move the body from the storage position (substantially upright) backwards from the head is small such that little or no physical exertion is required from the user.

The means for maintaining the body in the storage position (substantially upright) may be separate to the means for locking and/or the reciprocal means for locking.

Alternatively, the means for locking and/or the reciprocal means for locking may also provide the means for maintaining the body in the storage position (substantially upright). Thus the means for locking and/or the reciprocal means for locking may be the same feature as the means for maintaining the body in the storage position (substantially upright), or the means for maintaining the body in the storage position (substantially upright) may be located on and/or in, or may include the means for locking and/or the reciprocal means for locking.

The means for maintaining the body in the storage position (substantially upright) may be a fastener which is movable between an open and a closed position, such that when the fastener is in the closed position the body is maintained in the storage position (substantially upright), and such that when the fastener is in the open position the body is movable from the storage position (substantially upright). The fastener may close automatically when the body is in the storage position (substantially upright) or it may be manually operated by the user, i.e. the fastener may not close automatically when the body is in the storage position (substantially upright). The sufficient amount of force required to move the body from the storage position (substantially upright) backwards from the head may therefore be equivalent or comparable to the force required to open the fastener.

Preferably the means for maintaining the body in a substantially upright position is arranged such that application of the sufficient amount of force disengages the means for locking from the reciprocal means for locking.

Therefore, application of the sufficient amount of force required to move the body from the storage position (substantially upright) backwards from the head, may simultaneously or substantially simultaneously disengage the means for locking from the reciprocal means for locking. This allows the body to be moved laterally relative to the head immediately after application of the sufficient amount of force required to move the body from the storage position (substantially upright) backwards from the head.

The sufficient amount of force required to move the body from the storage position (substantially upright) backwards from the head may act primarily upon the means for locking and/or the reciprocal means for locking to disengage the means for locking from the reciprocal means for locking. Alternatively the sufficient amount of force required to move the body from the storage position (substantially upright) backwards from the head may act primarily upon the means for maintaining the body in the storage position (substantially upright), which means for maintaining the body in the storage position may not be the means for locking and/or the reciprocal means for locking.

Preferably the sufficient amount of force is the amount of force required to overcome a frictional resistance.

The frictional resistance may be provided by the movement of a surface over another surface, for example between a first friction-increasing member and a second friction-increasing member, wherein the first friction-increasing member and the second friction-increasing member are arranged such that cooperation of the first friction-increasing member with the second friction-increasing member provides a frictional resistance.

The means for maintaining the body in a storage position (substantially upright) may include, for example, a protrusion and a depression, wherein the depression is adapted to receive the protrusion. The protrusion may, for example, be located on the body, and the depression may be located on the head, or vice-versa. The protrusion may be resilient, or it may be resiliently deformable. The depression may include a lip, or it may be a hole. The protrusion may, for example, be a lug, and the depression may be the space between two lugs, wherein the lugs are arranged such that they may interlock.

The means for maintaining the body in a storage position (substantially upright) may also include means for preventing the body being moved towards the head when the body is in the storage position (substantially upright). For example, this may be achieved by a first stopping member and a second stopping member, wherein the first stopping member and the second stopping member are arranged such that cooperation of the first stopping member with the second stopping member prevents the body being moved towards the head when the body is in the upright position.

In a further embodiment the vacuum cleaner includes a ball for contacting the ground, wherein the ball is coupled to the body and/or to the head.

Therefore, including a ball in a vacuum cleaner provides a support on the ground for the body.

Preferably the ball is coupled to the body such that lateral movement of the body relative to the head effects lateral movement of the ball relative to the head.

This allows the body to pivot about a first axis and about a second axis relative to the head, i.e. laterally relative to the head, and also towards/backwards from the head. Therefore, the vacuum cleaner can be more easily moved around obstacles by a user. Coupling the body to the ball such that lateral movement of the body is coupled to lateral movement of the ball allows the ball to support the lateral movement of the body relative to the head.

Preferably the ball is arranged such that at least a part of the ball is rotatable, thereby allowing the part of the ball to roll on the ground.

Therefore at least a part of the ball is able to rotate and perform the same function as a wheel, thereby reducing friction between the ball and the ground when the vacuum cleaner is in use. A part of the ball may be rotatable, or the whole ball may be rotatable.

Preferably the means for locking and/or the reciprocal means for locking are located inside the ball.

This allows the means for locking and reciprocal means for locking to be concealed within the ball, thereby reducing the number of exposed moving parts, and increasing the safety of the toy vacuum cleaner.

In a further embodiment the head is coupled to a first elongate member and the body is coupled to a second elongate member and wherein the first elongate member is in communication with the second elongate member.

Therefore the first and the second elongate members provide features by which the head can be directly or indirectly coupled to the body.

Preferably the position of the first elongate member is substantially perpendicular to the position of the second elongate member, wherein the head is pivotable relative to the body about the axis of the first elongate member, thereby providing the first axis of rotation, and wherein the head is pivotable relative to the body about the axis of the second elongate member, thereby providing the second axis of rotation.

Therefore, the first and the second elongate member provide features by which the body can be rotated relative to the head about a first axis and about a second axis. The substantially perpendicular arrangement of the first and the second elongate member allows the first axis of rotation to be substantially perpendicular to the second axis of rotation, thereby allowing the body to pivot laterally relative to the head, and to pivot towards and backwards from the head.

The head may be fixed to the first elongate member, such that the head does not rotate about the first elongate member, or the head may be coupled to the first elongate member such that the head rotates about the first elongate member.

Preferably the first elongate member and the second elongate member are mounted on a supporting structure.

Therefore the first elongate member may be in communication with the second elongate member via the supporting structure. The first elongate member may be fixed to the supporting structure, or may be rotatable within the supporting structure. The second elongate member may be fixed to the supporting structure, or may be rotatable within the supporting structure.

The skilled person will be aware of many different bearing constructions which allow rotation about the axis of the first elongate member and about the axis of the second elongate member such that the body is pivotable relative to the head about the axis of the first elongate member and about the axis of the second elongate member.

Preferably the first elongate member and the second elongate member are arranged such that the means for locking and the reciprocal means for locking are engagable by cooperation of the first elongate member with the second elongate member. This is a preferred arrangement for the embodiment in which movement of the body from the storage position (substantially upright) backwards from the head disengages the means for locking from the reciprocal means for locking, thereby allowing the body to move laterally relative to the head.

The first elongate member and second elongate members may be located in close proximity to each other. Therefore, connecting the means for locking to the first elongate member and connecting the reciprocal means for locking to the second elongate member, or vice-versa, provides a simple and convenient way of integrating the means for locking and reciprocal means for locking into the vacuum cleaner. Movement of the first elongate member relative to the second elongate member may engage the means for locking and reciprocal means for locking, thereby resisting, preferably preventing, lateral movement of the body relative to the head by resisting, preferably preventing, rotation about the first axis of rotation, i.e. about the axis of the first elongate member.

The second elongate member may be fixed to the body or mounted on the body such that pivotal movement of the body relative to the head causes rotation of the second elongate member relative to the head. Thus, lateral movement of the body relative to the head causes the means for locking or the reciprocal means for locking to rotate, such that the means for locking engages with the means for locking when the body is in the storage position (substantially upright).

The means for locking may, for example, be a protrusion, and the reciprocal means for locking may be a depression, or vice-versa. The protrusion may be located on the body, and the depression may be located on the head, or vice-versa. The protrusion may be resilient, or it may be resiliently deformable. The depression may, for example, include a lip, or it may be a hole. The protrusion may, for example, be a hook. Alternatively, the protrusion and may, for example, be a lug, and the depression may be the space between two lugs, wherein the lugs are arranged such that the lugs interlock.

Preferably, the depression may be located on the first elongate member and the protrusion may be located on the second elongate member, or vice-versa. This is a preferred arrangement for the embodiment in which movement of the body backwards from the head disengages the means for locking from the reciprocal means for locking, thereby allowing the body to move laterally relative to the head Preferably the first elongate member is fixed relative to the head.

Fixing the first elongate member relative to the head may prevent the first elongate member from rotating when the means for locking has engaged with the reciprocal means for locking, thereby preventing lateral movement of the means for locking and/or the reciprocal means for locking relative to the head, thereby preventing lateral movement of the body relative to the head.

In a further embodiment the vacuum cleaner includes a stabiliser for contacting the ground.

The stabiliser provides additional support to prevent the vacuum cleaner falling over when the vacuum cleaner is in the storage position (substantially upright).

Preferably the stabiliser is coupled to the head such that in use the stabiliser maintains contact with the ground when the body is pivoted relative to the head in the first axis of rotation and/or the second axis of rotation.

This arrangement of the stabiliser and the head provides additional support for the vacuum cleaner. Coupling the stabiliser to the head rather than to the body allows the body to be pivoted relative to the head and relative to the stabiliser in the first and/or the second axis of rotation, thereby allowing the stabiliser to maintain contact with the ground when the vacuum cleaner is in use.

Preferably the stabiliser is connected to a first end of the first elongate member and the head is connected to a second end of the first elongate member.

This provides a convenient arrangement whereby the stabiliser is incorporated into the vacuum cleaner in such a way that the stabiliser maintains contact with the ground when the vacuum cleaner is in use.

Preferably the stabiliser includes a wheel for rolling on the ground.

This reduces friction between the stabiliser and the ground. The stabiliser may include one or more wheels.

In a second aspect the invention provides:

A vacuum cleaner including a head for contacting the ground, a stabiliser for contacting the ground, and a body, wherein the body is pivotable relative to the head about a first axis of rotation and about a second axis of rotation, and the body is pivotable relative to the stabiliser about a first axis of rotation and about a second axis of rotation, and wherein the stabiliser is coupled to the head such that in use the stabiliser maintains contact with the ground when the body is rotated relative to the head about the first axis of rotation and/or when the body is rotated relative to the head about the second axis of rotation.

The vacuum cleaner according to the second aspect of the invention does not require an additional stabilising device to be fixed in position to maintain the body the storage position (substantially upright). Instead, the stabiliser maintains contact with the ground when the vacuum cleaner is in use. Importantly, the stabiliser does not prevent the body from moving laterally relative to the head.

The vacuum cleaner according to the second aspect of the invention may also include any of the features described in the context of the first aspect of the invention.

BRIEF DESCRIPTION OF THE DRAWINGS

Embodiments of the invention will now be illustrated by way of example, with reference to the accompanying drawings, in which:

FIG. 1 is a schematic drawing of a vacuum cleaner showing a mechanism which prevents the body from moving laterally relative to the head when the body is in an upright position, and which allows the body to be moved laterally relative to the head when the body is moved backwards from the head.

FIG. 6 is a three-dimensional schematic drawing according to the embodiment shown in FIG. 1, and shows the body pivoting laterally relative to the head.

FIG. 7 is a three dimensional schematic drawing of a vacuum cleaner showing a mechanism which resists lateral movement of the body relative to the head when the body is in an upright position, and which allows the body to be freely moved laterally relative to the head after a lateral force is applied to the body by a user.

FIG. 8 is a three-dimensional schematic drawing according to the embodiment shown in FIG. 7, and shows the mechanism which maintains the body in the substantially upright position.

DETAILED DESCRIPTION OF THE INVENTION

Example 1

Figure 1A:
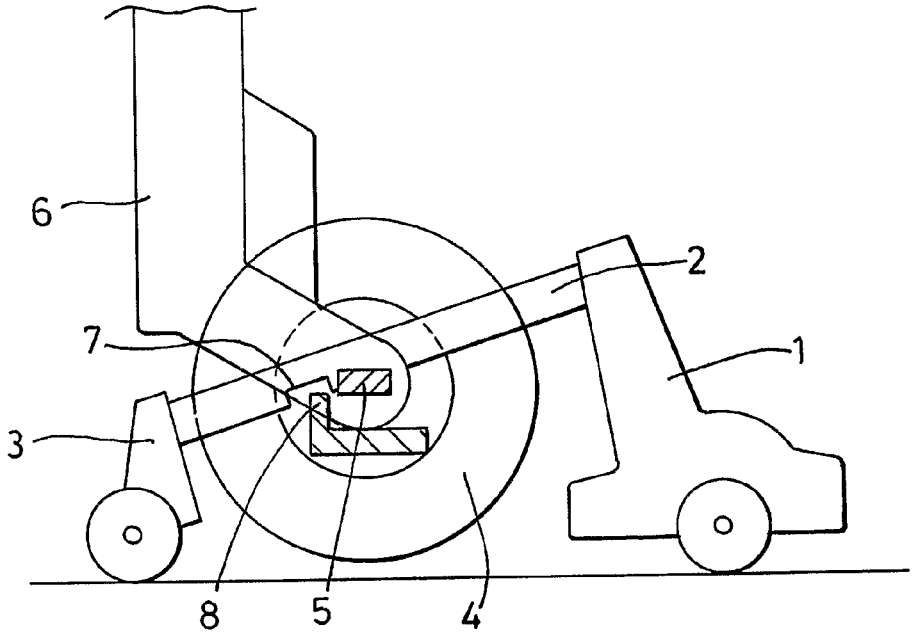
FIG. 1A is a cross-sectional schematic view showing the body in the upright position.

As shown in FIG. 1, the vacuum cleaner has a head (1) which is fixed to one end of a first elongate member or shaft (2), and the other end of the first elongate member is fixed to a stabiliser (3). A ball (4) is rotatably mounted on the first elongate member, and also rotatably mounted on a second elongate member or shaft (5). The second elongate member is substantially perpendicular to, and below the first elongate member. A body (6) is fixed to the second elongate member. The first elongate member (2) has a hole (7), and the second elongate member has a protrusion (8) which can be received by the hole of the first elongate member. A supporting structure or brace which is connected to the first elongate member and the second elongate member is not shown to increase clarity.

Figure 2:
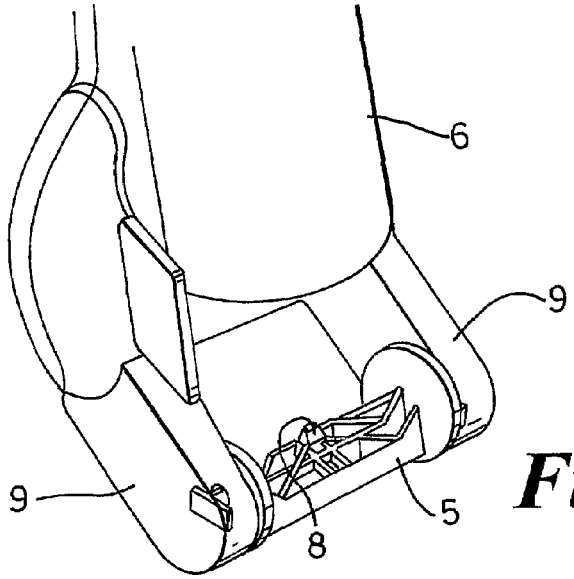
FIG. 2 is a three-dimensional schematic drawing according to the embodiment shown in FIG. 1, and shows the body connected to the second elongate member.

As shown in FIG. 2, the body (6) has two legs (9); each leg of the body is connected to end of the second elongate member (5).

Figure 3:
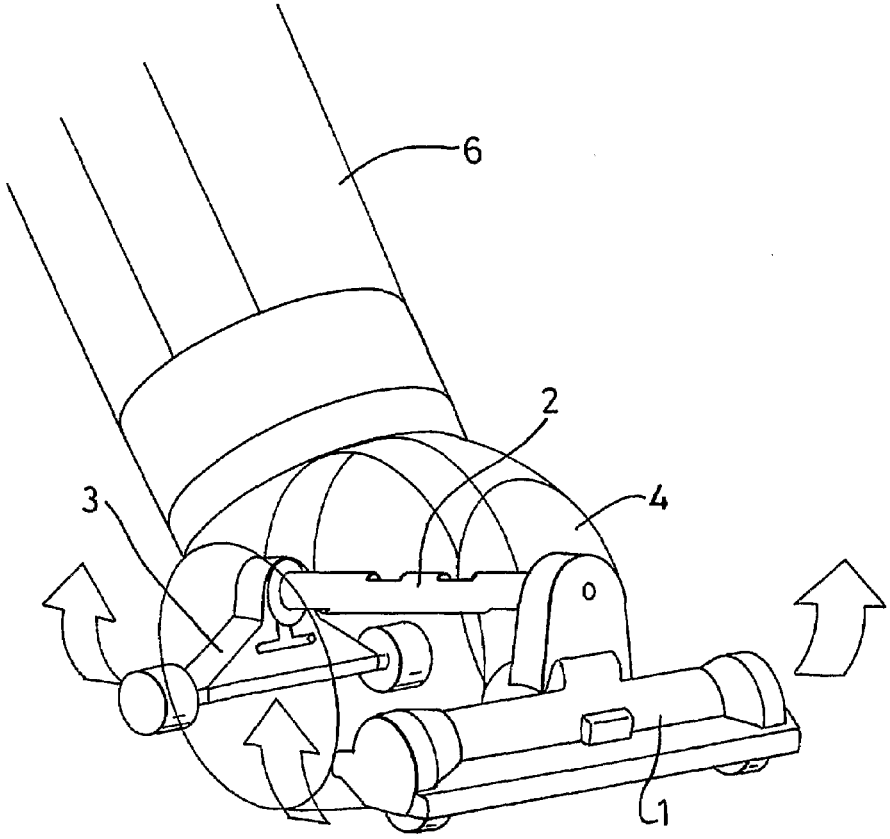
FIG. 3 is a three-dimensional schematic drawing according to the embodiment shown in FIG. 1, and shows the head and the stabiliser connected to the first elongate member. The legs of the body which connect the ball to the body are not shown.

As shown in FIG. 3, the head (1) and the stabiliser (3) are fixed to opposite ends of the first elongate member (2) such that rotational movement of the head with respect to the ball effects rotational movement of the stabiliser. Note that the legs of the body which connect the ball to the body via the second elongate member are not shown to increase clarity.

Figure 4:
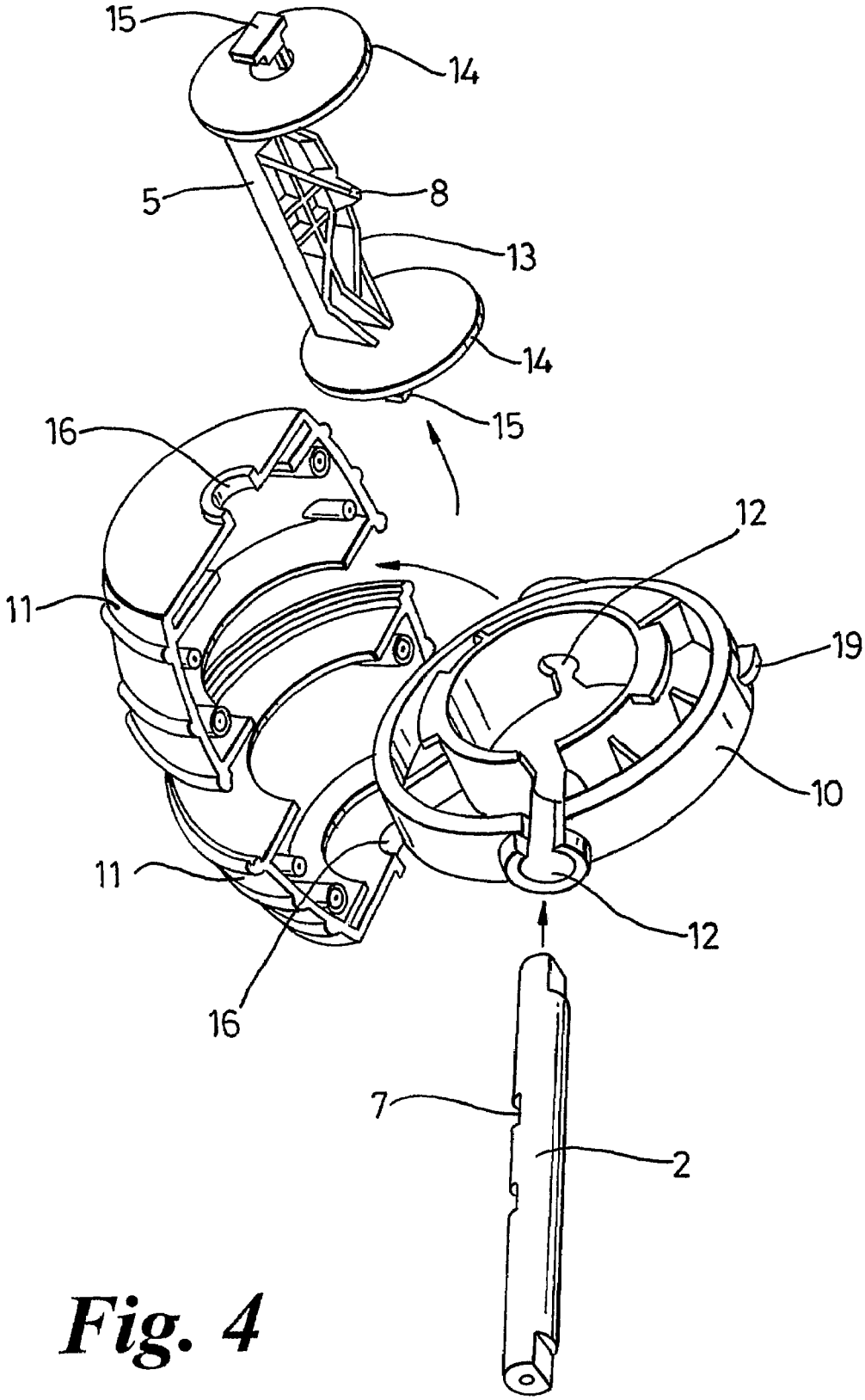
FIG. 4 is a three-dimensional exploded schematic drawing of the ball according to the embodiment shown in FIG. 1.

As shown in FIG. 4, the ball consists of a central ring (10) and two cups (11). Note that only half of each cup is shown in FIG. 4 to increase clarity. Each cup is rotatably mounted on either side of the circumference of the central ring. The central ring has two opposite holes (12) to accept the first elongate member (2) such that the first elongate member passes through the diameter of the central ring. The second elongate member (5) consists of a bar (13) mounted between two parallel discs (14). The bar is mounted such that it is off-set from the central point of each disc. The second elongate member also has two pins (15), one pin is joined to the outer side of each disc. The bar includes the protrusion (8), which is located at the mid-point between the two discs. The two cups each have a circular hole (16) in their flat side to receive each pin of the second elongate member.

Figure 5A:
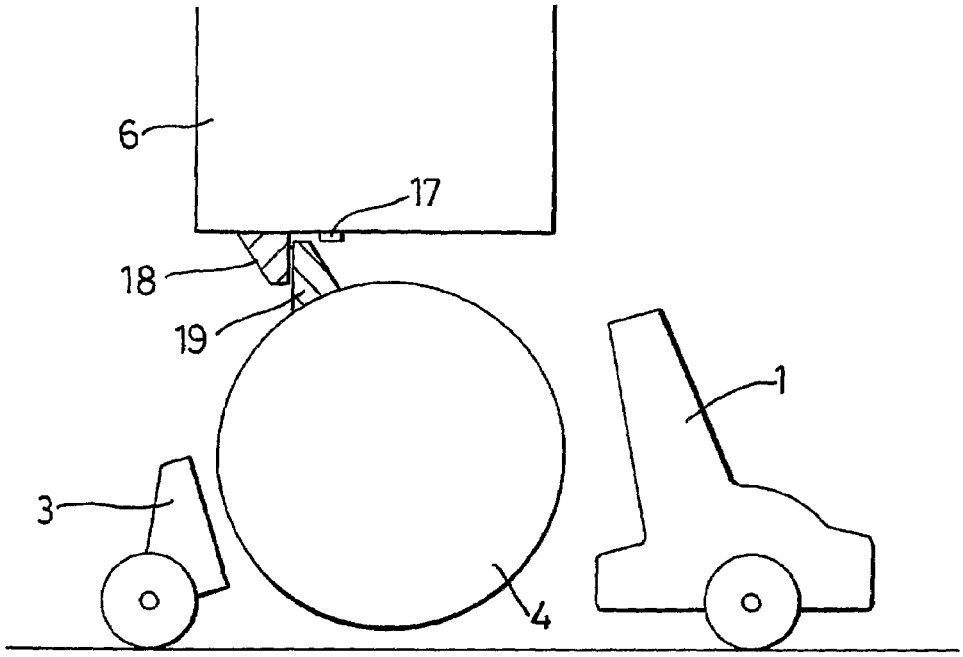
FIG. 5 is a schematic drawing showing according to the embodiment of FIG. 1, and shows the mechanism which maintains the body in the storage position.
Figure 5B:
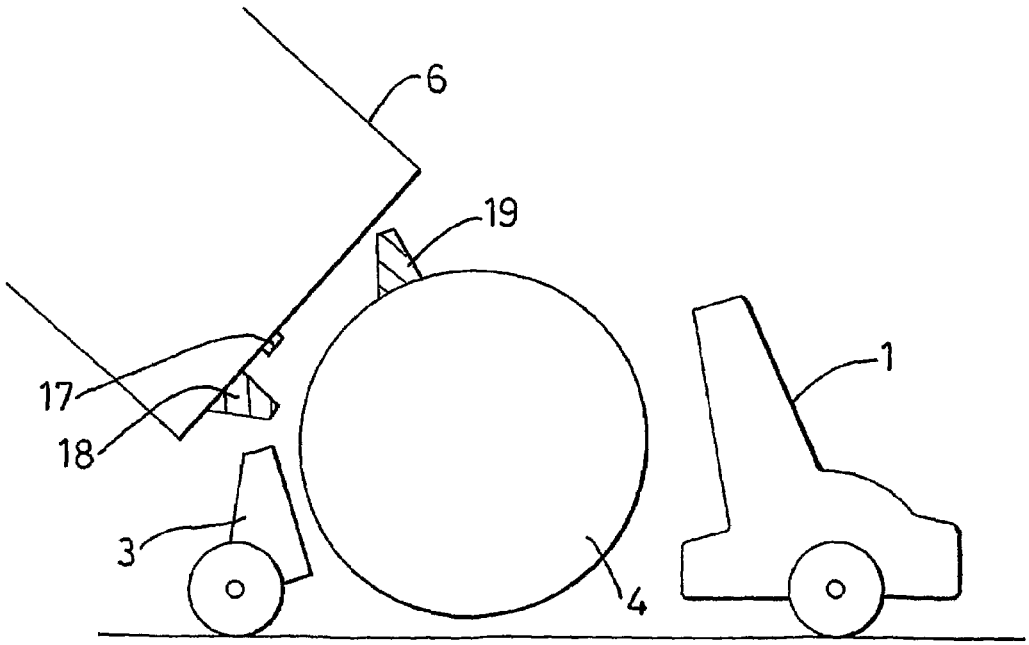

As shown in FIG. 5, the vacuum cleaner has a lug (17) mounted on the body (6), a first stopping member (18) mounted on the body, and a second stopping member (19) mounted on the ball (4). The lug and the first stopping member are joined to the body, and the second stopping member is joined to the ball. The space between the lug and the first stopping member accommodates the second stopping member.

Figure 1B:
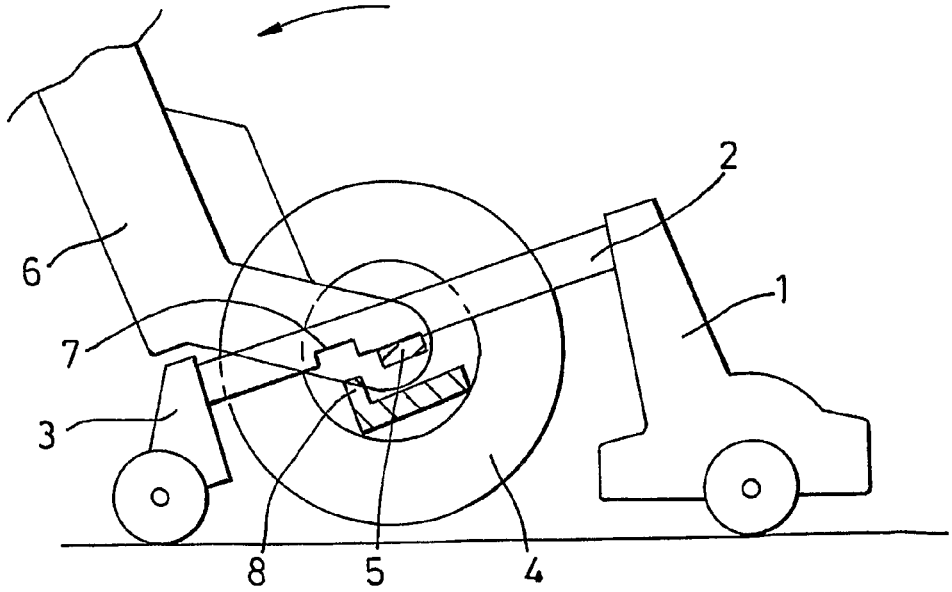
FIG. 1B is a cross-sectional schematic view showing the body in an inclined position.
Figures 6A, 6B, 6C:
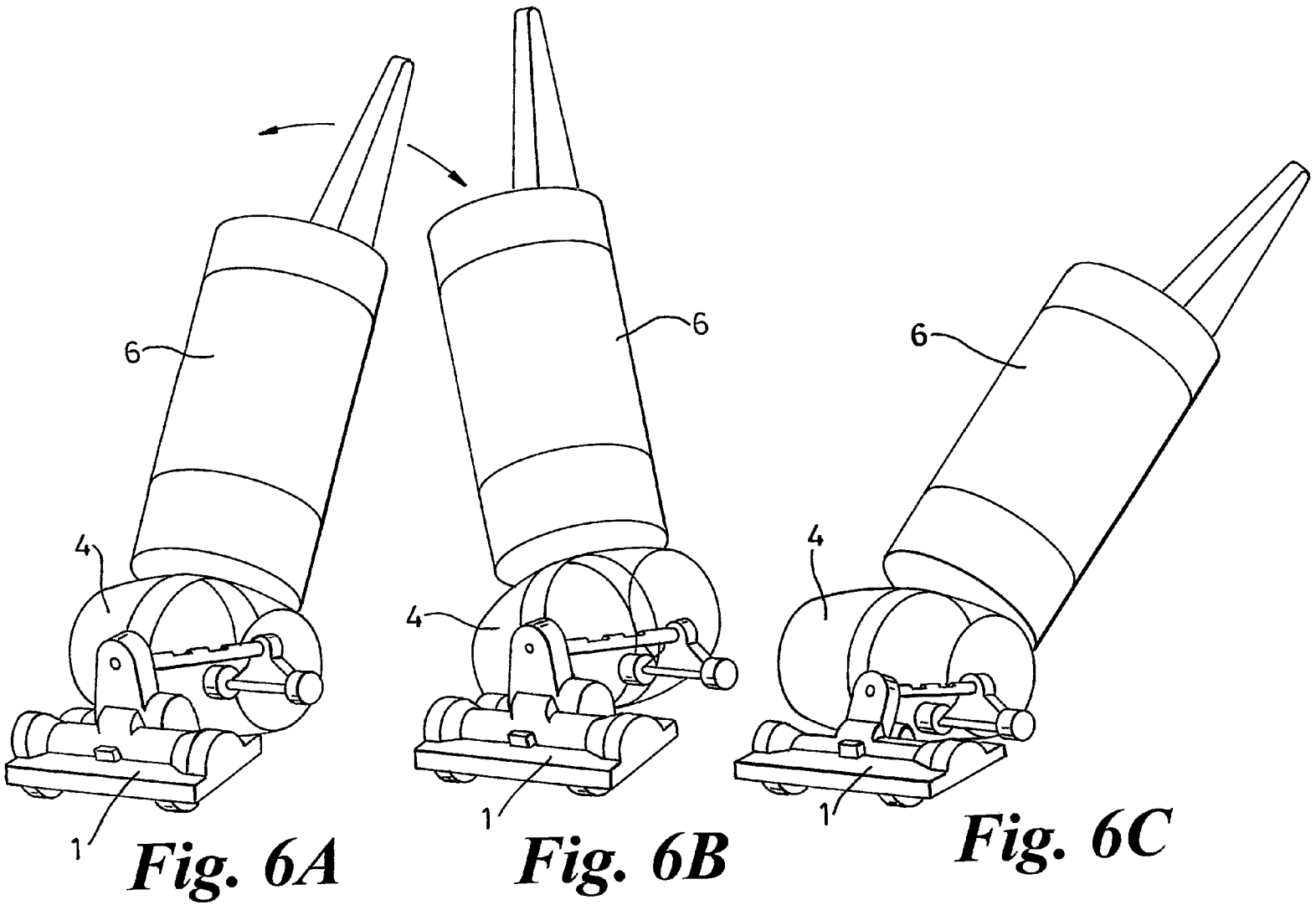
FIG. 6A shows the body parallel to the head.
FIG. 6B shows the body pivoted to the right of the head.
FIG. 6C shows the body pivoted to the left of the head.

When the body is in an upright position, i.e. a storage position, the protrusion (8) on the second elongate member (5) enters the hole (7) on the first elongate member (2), thereby preventing the body (6) from moving laterally relative to the head (1), as shown in FIG. 1A. When the body is in an inclined position backwards from the head, the protrusion on the second elongate member comes out of the hole on the first elongate member, as shown in FIG. 1B, thereby allowing the body to be rotated laterally relative to the head, as shown in FIG. 6.

When the body is in an upright position, the second stopping member (19) sits behind the lug (17), as shown in FIG. 5. This prevents the body tilting backwards from the head, until a force is applied by the user to tilt the body backwards. In addition, the first stopping member (18) contacts the second stopping member (19), thereby preventing the body from tilting towards the head from the upright position.

The stabiliser (3) remains on the ground when the body (6) is in an upright position, and when the body is in an inclined position, as shown in FIG. 1.

Example 2

Figure 7A:
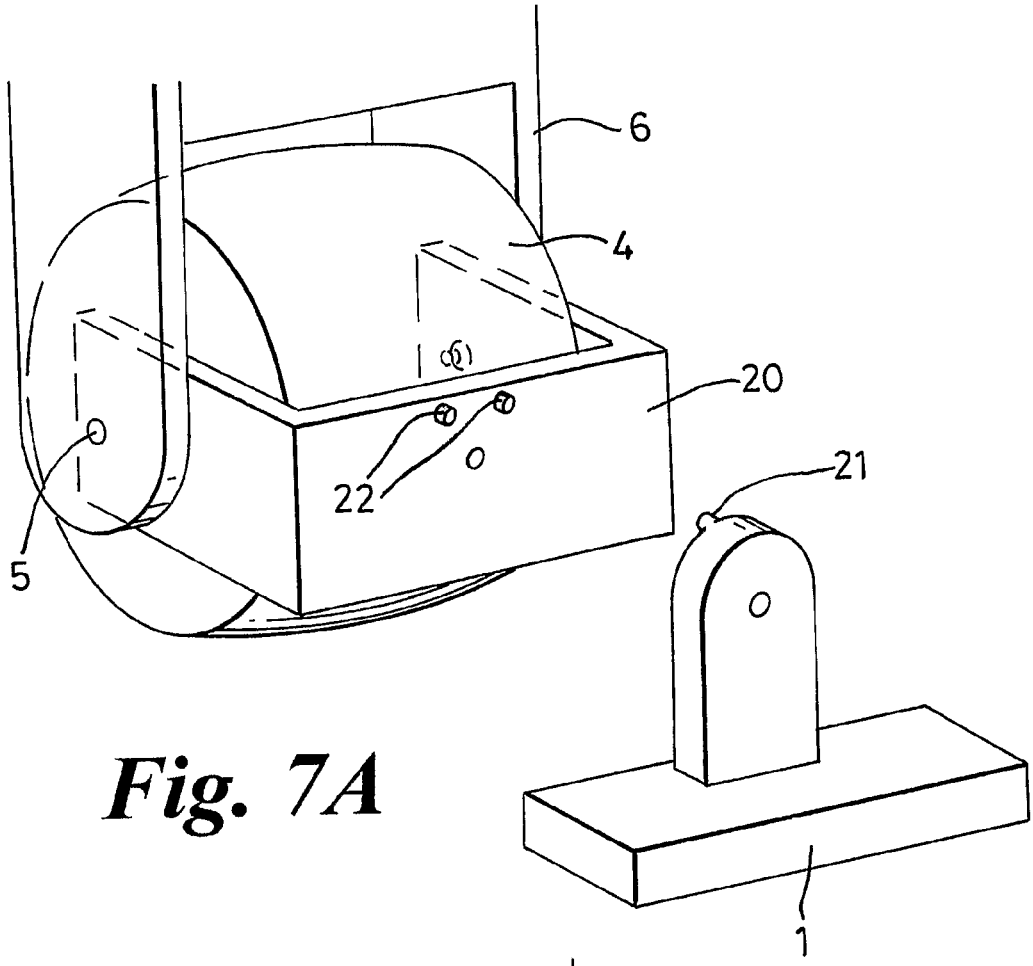
FIG. 7A is an exploded view showing the body removed from the supporting structure.
Figure 7B:
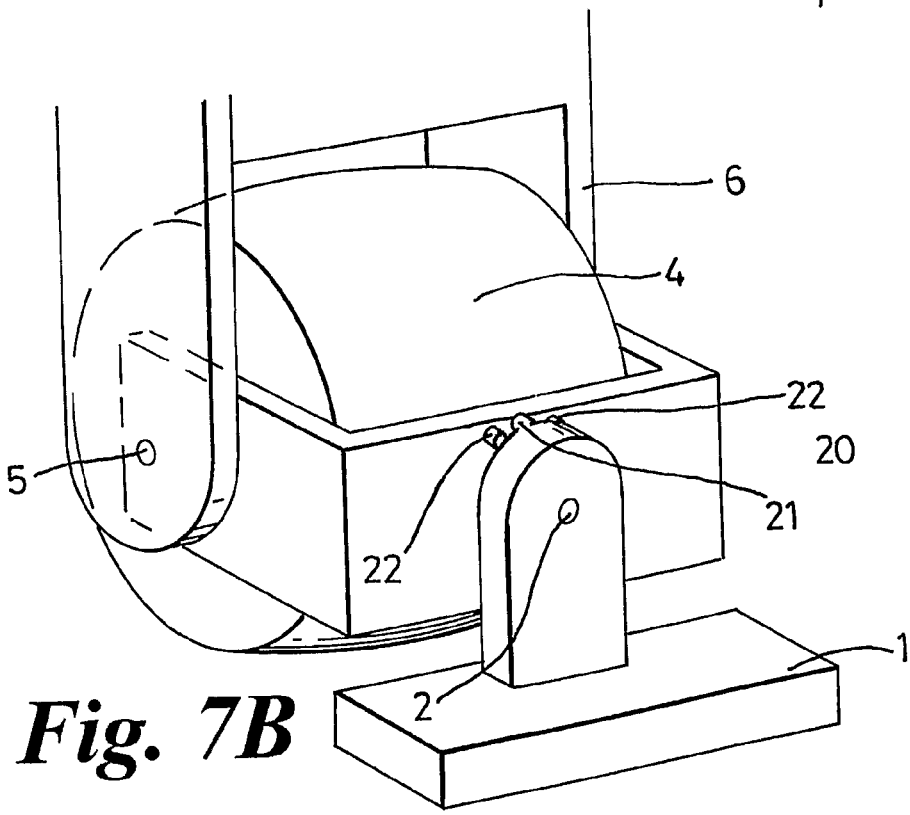
FIG. 7B shows the head connected to the supporting structure.

As shown in FIG. 7, a further vacuum cleaner according to the invention has a head (1) which is connected to a supporting structure (20) by a first elongate member or shaft (2). The body (6) is connected to the supporting structure by a second elongate member or shaft (5). A ball (4) sits inside the supporting structure or brace and is rotatably mounted on the second elongate member. A resilient lug (21) is mounted on the head, and a pair of resilient lugs (22) are mounted on the supporting structure, such that the lug (21) can interlock with the pair of lugs (22).

Figure 8A:
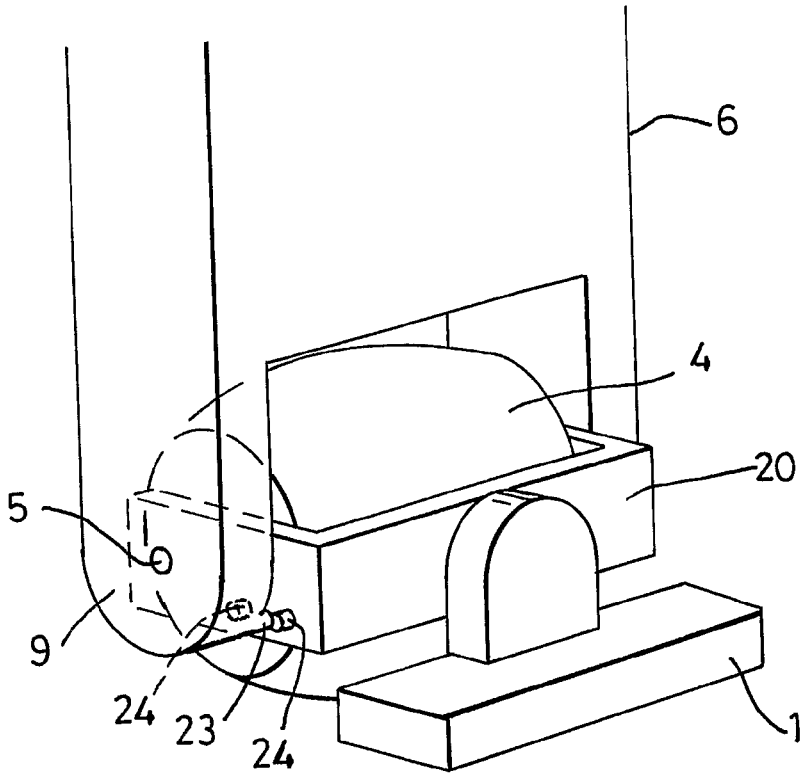
FIG. 8A shows the body in the substantially upright position.
Figure 8B:
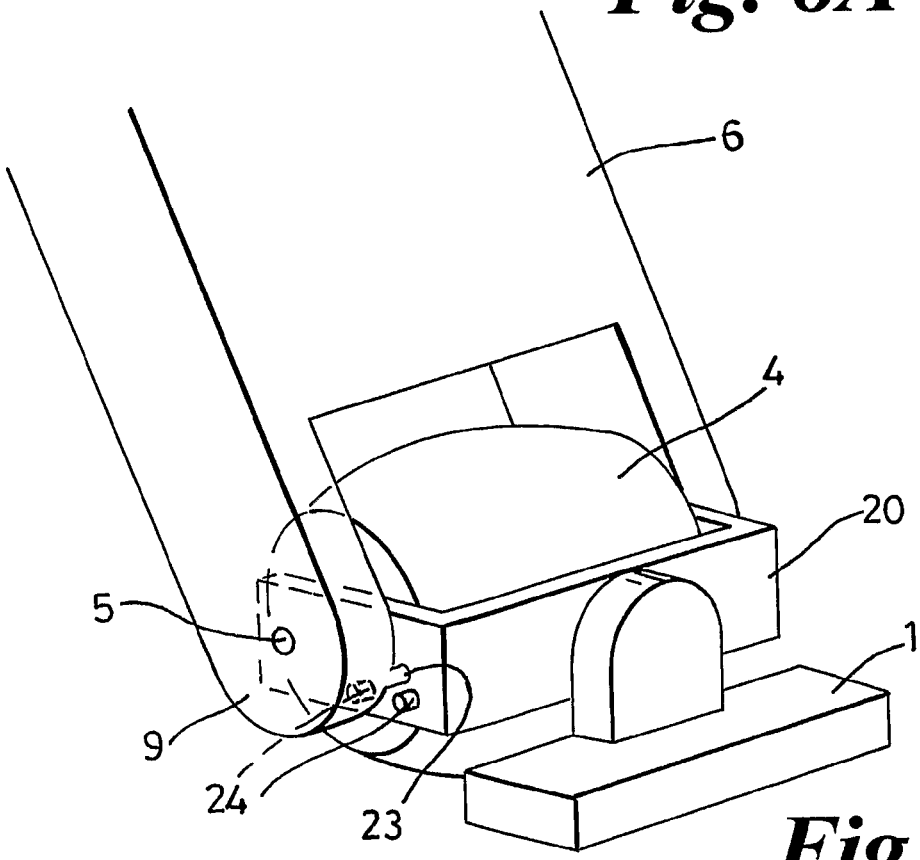
FIG. 8B shows the body in the inclined position.

As shown in FIG. 8, the vacuum cleaner also has a resilient lug (23) mounted on a leg (9) of the body (6), and a pair of resilient lugs (24) mounted on the supporting structure (20), such that the lug (23) can interlock with the pair of lugs (24).

When the body (6) is parallel to the head (1), i.e. the body is not moved laterally relative to the head, the lug (21) mounted on the head interlocks with the pair of lugs (22) mounted on the supporting structure (20). The interlocked lugs resist lateral movement of the body relative to the head until a force is applied on the body by a user in the desired lateral direction relative to the head. The force applied by the user causes the lug (21) to move past the pair of lugs (22), thereby allowing the body to be freely moved in the desired lateral direction. The same operation allows the body to be moved in the opposite lateral direction, i.e. by applying a force in the opposite lateral direction.

The head and the supporting structure may be joined to the first elongate member such that the head is movable towards and away from the supporting structure. This arrangement allows the lugs to interlock and disengage more easily. A spring may also be mounted between the head and the supporting structure such that head is urged towards the supporting structure. This spring therefore allows the head to move away from the supporting structure whilst the lugs are interlocking. Once the lugs have interlocked the spring provides resistance to disengagement of the lugs by urging the head towards the supporting structure.

When the body is in an upright position, i.e. the storage position, the lug mounted on the leg (9) of the body (6) interlocks with the pair of lugs (24) mounted on the supporting structure (20). The interlocked lugs resist the body tilting backwards from the head until a force is applied on the body by a user to tilt the body backwards. The force applied by the user causes the lug (23) to move past the pair of lugs (24), thereby allowing the body to be freely moved backwards and towards the head.

Figure 9:
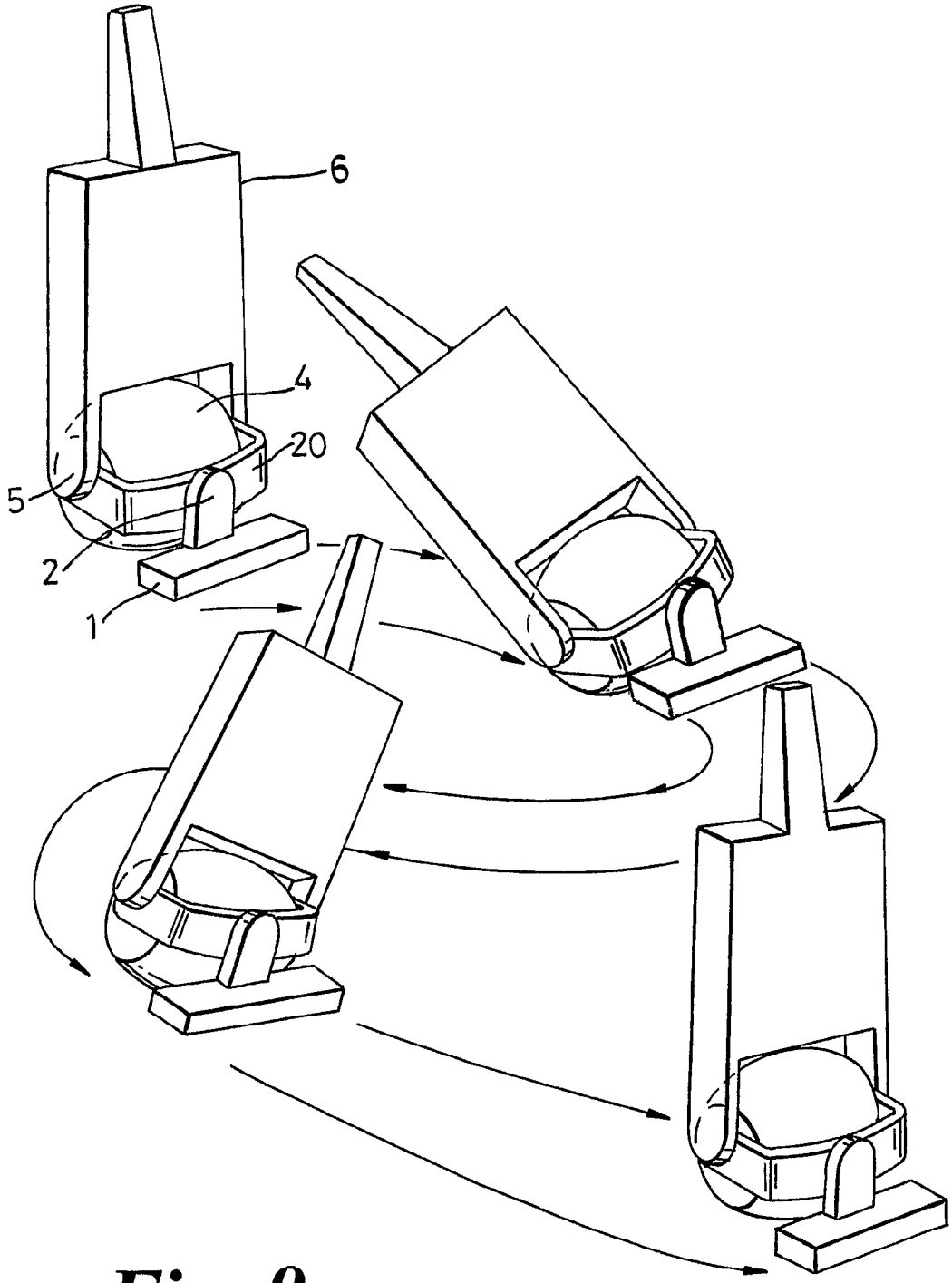
FIG. 9 is a three-dimensional schematic drawing according to the embodiment shown in FIG. 7, and shows the body pivoting laterally relative to the head, and backwards relative to the head.

Therefore, the body is maintained in the upright position when the lug (21) interlocks with the pair of lugs (22), and the lug (23) interlocks with the pair of lugs (24). The body can be moved by a user to an inclined in-use position by applying a force to tilt the body backwards, and by applying a force to move the body laterally relative to the head. Therefore the body can be moved both laterally relative to the head, and forwards and backwards relative to the head, as shown in FIG. 9.

It is to be understood that variants of the above described embodiments of the invention in its various aspects, such as would be readily apparent to the skilled person, may be made without departing from the scope of the invention in any of its aspects.

The invention claimed is:

1. A vacuum cleaner, comprising a head and a ball for contacting the ground and a body, wherein the ball is coupled to the body or to the head, wherein the body is pivotable relative to the head about a first axis of rotation and about a second axis of rotation, wherein the body has a locking mechanism and the head has a reciprocal locking mechanism, wherein the locking mechanism and the reciprocal locking mechanism are configured such that the locking mechanism is engageable with the reciprocal locking mechanism, thereby resisting pivotal movement of the body relative to the head about the first axis of rotation, wherein the locking mechanism is disengageable from the reciprocal locking mechanism by pivotal movement of the body relative to the head, thereby allowing pivotal movement of the body relative to the head about the first axis of rotation, and wherein the locking mechanism and the reciprocal locking are located inside the ball.

2. The vacuum cleaner of claim 1, wherein the head and the body are configured such that the body is movable laterally relative to the head by pivotal movement about the first axis of rotation, and the body is movable towards the head and backwards from the head by pivotal movement about the second axis of rotation.

3. The vacuum cleaner of claim 1, wherein the locking mechanism and the reciprocal locking mechanism are configured such that the locking mechanism engages with the reciprocal locking mechanism when the body is in a substantially upright position, thereby resisting the body moving laterally relative to the head when the body is in the substantially upright position.

4. The vacuum cleaner of claim 1 or 2, wherein the locking mechanism and the reciprocal locking mechanism are configured such that the locking mechanism is disengageable from the reciprocal locking mechanism by pivotal movement of the body relative to the head about the second axis of rotation, thereby allowing pivotal movement of the body relative to the head about the first axis of rotation.

5. The vacuum cleaner of claim 4, wherein the head and the body are configured such that when the body is in the substantially upright position, movement of the body backwards from the head disengages the locking mechanism from the reciprocal locking mechanism, thereby allowing the body to move laterally relative to the head.

6. The vacuum cleaner of claim 4, wherein engagement of the locking mechanism with the reciprocal locking mechanism prevents pivotal movement of the body relative to the head about the first axis of rotation.

7. The vacuum cleaner of claim 1 or 2, wherein the vacuum cleaner includes means for maintaining the body in a substantially upright position, wherein the means for maintaining the body in the substantially upright position is configured such that a sufficient amount of force is required to move the body from the substantially upright position backwards from the head.

8. The vacuum cleaner of claim 7, wherein the means for maintaining the body in a substantially upright position is configured such that application of the sufficient amount of force disengages the locking mechanism from the reciprocal locking mechanism.

9. The vacuum cleaner of claim 7, wherein the sufficient amount of force is the amount of force required to overcome a frictional resistance.

10. The vacuum cleaner of claim 1 or 2, wherein the ball is coupled to the body such that lateral movement of the body relative to the head effects lateral movement of the ball relative to the head.

11. The vacuum cleaner of claim 1 or 2, wherein the ball is configured such that at least a part of the ball is rotatable, thereby allowing the part of the ball to roll on the ground.

12. The vacuum cleaner of claim 1 or 2, including a stabilizer for contacting the ground.

13. The vacuum cleaner of claim 12, wherein the stabilizer is coupled to the head such that in use the stabilizer maintains contact with the ground when the body is pivoted relative to the head in the first axis of rotation and/or the second axis of rotation.

14. The vacuum cleaner of claim 12, wherein the stabilizer is connected to a first end of first elongate member and the head is connected to a second end of the first elongate member.

15. The vacuum cleaner of claim 12, wherein the stabilizer includes a wheel for rolling on the ground.

* * * * *